United States Patent [19]

Burk

[11] Patent Number: 4,523,514

[45] Date of Patent: Jun. 18, 1985

[54] POSITION SENSING CYLINDER

[75] Inventor: Ronnie F. Burk, Waterloo, Iowa

[73] Assignee: Deere & Company, Moline, Ill.

[21] Appl. No.: 594,425

[22] Filed: Mar. 29, 1984

Related U.S. Application Data

[63] Continuation of Ser. No. 300,331, Sep. 8, 1981, abandoned.

[51] Int. Cl.[3] ..... F01B 25/26

[52] U.S. Cl. ..... 92/5 R; 91/1; 338/176; 338/184

[58] Field of Search ..... 92/5 R; 91/1, 363 R; 338/176, 180, 183, 184

[56] References Cited

U.S. PATENT DOCUMENTS

| | | | |
|---|---|---|---|
| 2,343,425 | 3/1944 | Smith | 201/62 |
| 2,706,230 | 4/1955 | Bourns et al. | 201/62 |
| 2,785,262 | 3/1957 | Bourns | 201/62 |
| 2,799,757 | 6/1957 | Bourns et al. | 201/62 |
| 3,160,836 | 12/1964 | Farley | 336/30 |
| 3,175,094 | 3/1965 | Farley | 290/1 |
| 3,412,391 | 11/1968 | Ward | 340/282 |
| 3,453,937 | 7/1969 | Haberman | 91/1 |
| 3,572,214 | 3/1971 | Woodward | 91/457 |
| 3,639,880 | 2/1972 | Oka | 338/183 |
| 3,720,118 | 3/1973 | McCormic | 91/363 R |
| 3,726,191 | 4/1973 | Johnston et al. | 92/5 R |
| 3,839,944 | 10/1974 | Swift | 92/5 R |
| 3,915,070 | 10/1975 | Mailliet | 92/5 R |
| 3,996,550 | 12/1976 | Yano et al. | 338/183 |
| 4,053,865 | 10/1977 | Brown, Jr. | 338/180 |
| 4,076,214 | 2/1978 | Colly | 91/363 R |
| 4,121,504 | 10/1978 | Nowak | 92/5 R |
| 4,179,982 | 12/1979 | Saotome | 92/5 R |
| 4,365,538 | 12/1982 | Andoh | 91/1 |
| 4,386,552 | 6/1983 | Foxwell | 92/5 R |

FOREIGN PATENT DOCUMENTS 1382342 11/1964 France .

OTHER PUBLICATIONS

Exhibit AR is a Drawing of a McCormick Servo Controls, Inc., Hydraulic Actuator with a Feedback Potentiometer.

*Primary Examiner*—Abraham Hershkovitz

[57] ABSTRACT

A position-sensing cylinder includes a hollow housing within which reciprocates a piston fixed to a hollow rod. A hollow fitting is threadably attached to one end of the housing. a hollow metallic insert is press fitted into the hollow fitting. An elongated potentiometer support is received by and welded to the insert and is reciprocally received by the hollow rod. The support includes curved edges which slidably engage the wiper wall of the hollow rod and includes a planar support surface upon which are mounted resistive and conductive potentiometer strips. A hollow wiper carrier is mounted for movement with the piston and rod so that the support reciprocates within the carrier and so that conductive wipers are maintained in contact with the potentiometer strips. The wiper carrier cooperates with the rod and the support to substantially prevent fluid flow in the vicinity of the wipers.

6 Claims, 10 Drawing Figures

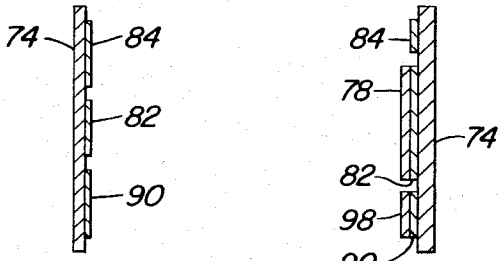
FIG. 6a
FIG. 6b
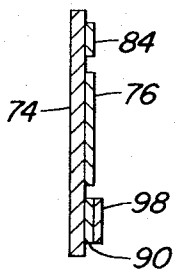
FIG. 6c
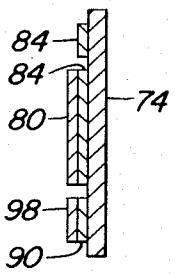
FIG. 6d
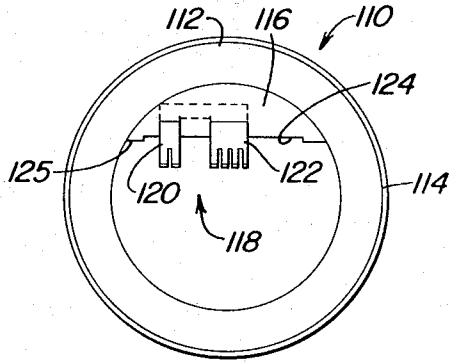
FIG. 7

POSITION SENSING CYLINDER

This application is a Continuation of application Ser. No. 300,331, filed 8 Sept. 1981 now abandoned.

BACKGROUND OF THE INVENTION

This invention relates to a hydraulic cylinder with a potentiometric position-sensing transducer.

In hydraulic controls technology, it is often desirable to obtain feedback signals representing the operating position of a hydraulic cylinder. U.S. Pat. No. 3,726,191 discloses one solution to this problem. The '191 cylinder has a resistance and conductor element support reciprocally received in a piston rod bore. A conductive wiper assembly is carried for movement with the piston and rod. However, the transducer construction of the '191 patent requires a relatively large transducer cross section which displaces a large volume of hydraulic fluid as the cylinder rod moves with respect to the transducer assembly. The bore required in the cylinder rod to accommodate such a transducer of large cross section and to provide an escape path for displaced hydraulic fluid is so large as to prevent its use in many hydraulic cylinders where compact size is required. Furthermore, the wiper contacts of the '191 patent are suspended in the fluid escape path, allowing flow forces to vibrate or bend the contact leaf, resulting in operation noise and loss of signal, respectively. Finally, the element support is supported only at one end by a plastic sealing element which is subject to mechanical stress and failures.

SUMMARY OF THE INVENTION

An advantage of the present invention is that it provides a position-sensing cylinder with good immunity to electrical noise caused by hydraulic flow-induced vibration.

Another advantage of the present invention is that it provides a position-sensing cylinder with a potentiometer element support with good rigidity and low cross-section area.

Another advantage of the present invention is that it provides a potentiometer support element which is mechanically supported along the length of its engagement with the cylinder rod bore.

A further advantage of the present invention is that it provides a position-sensing cylinder with an improved fluid pressure seal which is spaced apart from the potentiometer support and thus, not subject to mechanical stress caused by the support of the potentiometer support.

These and other advantages are achieved by the present invention which provides a position-sealing cylinder with a T-shaped potentiometer support with one end welded or fixed to a hollow metallic terminal which is press fitted into a fitting which is threadably attached to one end of the cylinder housing. A ceramic plug seals the interior of the terminal, but provides no support for and is separate from the support. Further support for the potentiometer support is provided by the sliding engagement between it and the wall of the rod bore within which the potentiometer support reciprocates. A wiper carrier cooperates with the bore wall and the potentiometer support to prevent fluid flow in the vicinity of the flexible wiper contacts.

BRIEF DESCRIPTION OF THE DRAWINGS

FIGS. 6*a* through 6*d* are unscaled sectional views taken in the direction of arrows A—A, B—B, C—C and D—D, respectively, of FIG. 5.

FIG. 7 is an end view of the wiper carrier of the invention.

DETAILED DESCRIPTION

Figure 1:
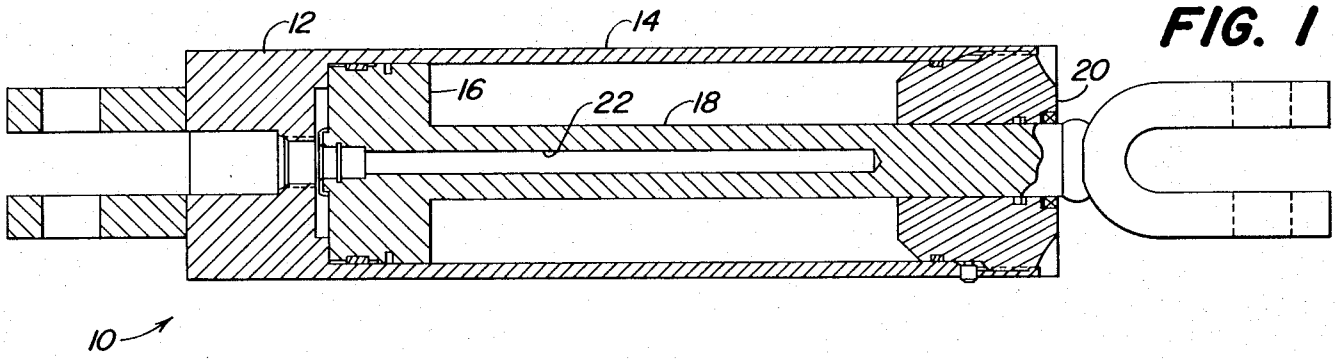
FIG. 1 is a cross-sectional view of the hydraulic cylinder for the present invention.

A fluid actuator or hydraulic cylinder 10 includes a housing 12 having a hollow cylindrical barrel portion 14 within which reciprocates a piston 16 connected to a rod 18. A rod-receiving cap 20 is threadably connected to an end of the housing 12. A blind stepped bore 22 extends into the piston 16 and the rod 18.

Figure 2:
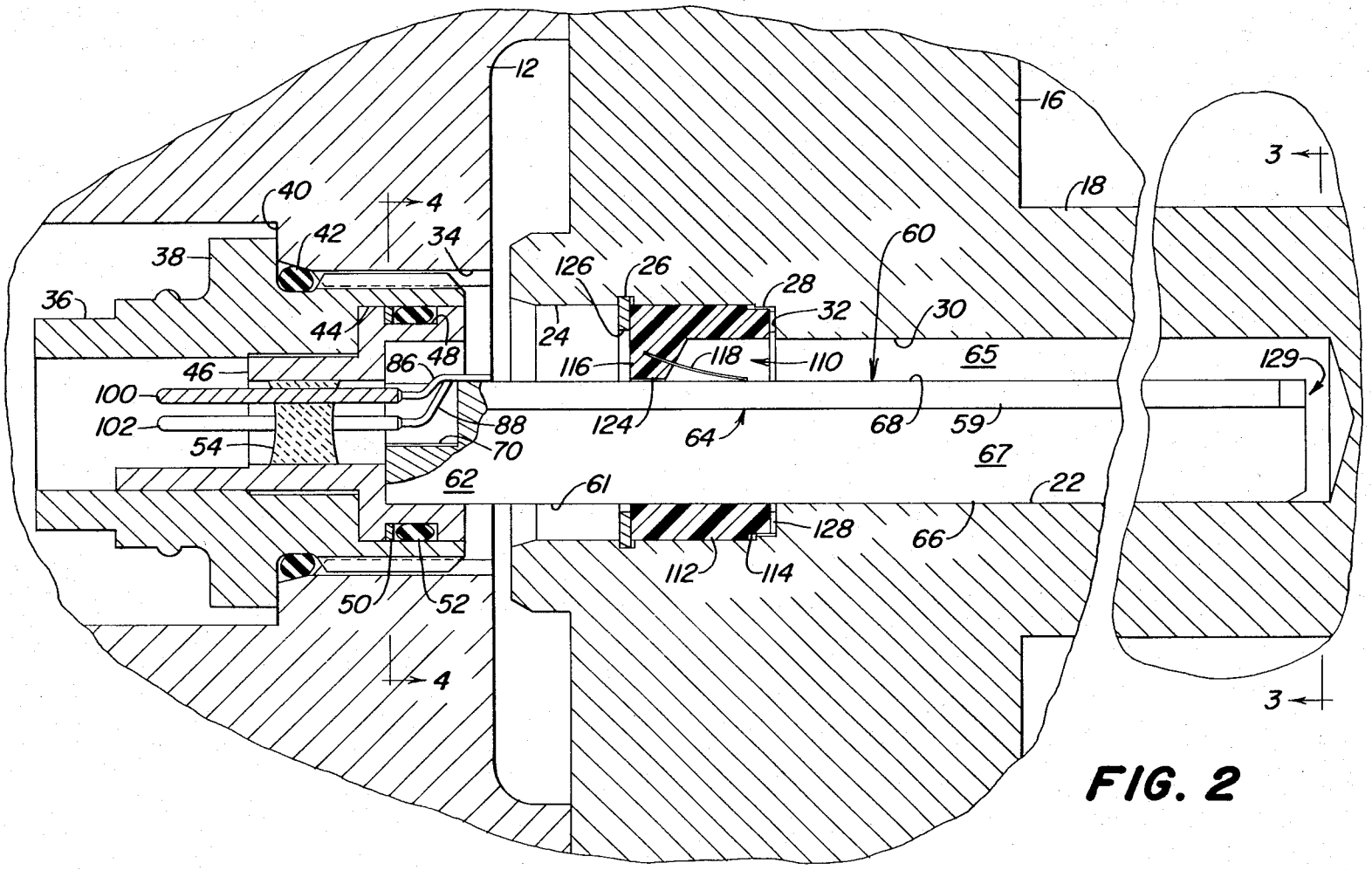
FIG. 2 is a partial sectional view of a portion of applicant's invention.
Figure 5:
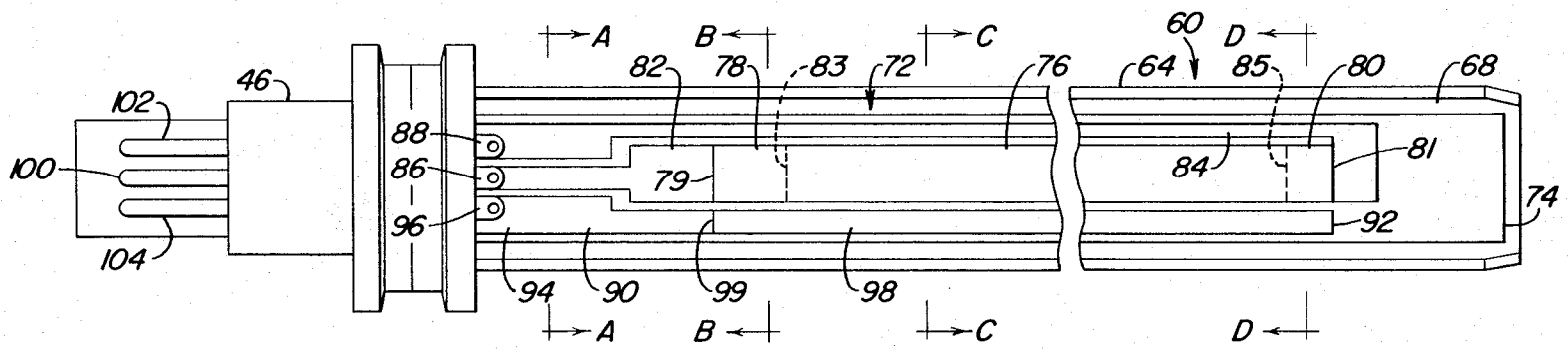
FIG. 5 is a top view of the terminal piece and the transducer support of the invention.

As best seen in FIG. 2, the bore 22 has a large diameter portion 24 with a snap ring groove 26 therein and an annular ridge 28 at one end, a smaller diameter portion 30 and an annular shoulder 32 extending therebetween.

The housing 12 includes a threaded axial bore 34 for threadably receiving a steel outer transducer fitting 36. Fitting 36 includes a raised annular flange 38 for butting against a corresponding housing shoulder 40. An O-ring 42 maintains a fluid-tight seal between the fitting 36 and the housing 12. Fitting 36 also includes a stepped axial bore 44 extending therethrough.

A steel terminal piece 46 is press fitted into the fitting bore 44. Terminal 46 includes an annular groove 48 which receives a back-up ring 50 and an O-ring 52 for maintaining a fluid seal between the fitting 36 and the terminal 46. A portion of ceramic material 54 is formed in the hollow interior of the terminal 46 to form a hermetic seal therein. The terminal 46 is formed as a separate piece from the fitting 36 so that when the ceramic material 54 is heated within the terminal 46, the fitting 36 is not degraded by the high temperature to which it would otherwise be exposed if the fitting 36 and the terminal 46 were a single piece.

A steel support element 60 extends into the bore 22 from an end 62 received by and welded to the terminal 46. Thus, the end 62 of the support 60 is rigidly supported with respect to the housing 12 by metallic pieces 36 and 46, whereas other position-sensing cylinders, such as described in U.S. Pat. No. 3,726,191, have supported the transducer support element by press fitting the support into a plastic insulating sleeve, which is, in turn, received by a metallic threaded fitting. In this arrangement, the transducer support is less rigidly supported at its supported end and the plastic insulating material is subject to stress failures, such as cracking, which then degrades its sealing properties. Furthermore, in the instant invention, the ceramic seal 54 is subject to very little mechanical stress caused by supporting the support 60. Instead, the ceramic seal 54 need only withstand the hydraulic pressures for which it is designed to withstand, with the result that the instant invention has increased integrity with respect to fluid pressure sealing.

Figure 4:
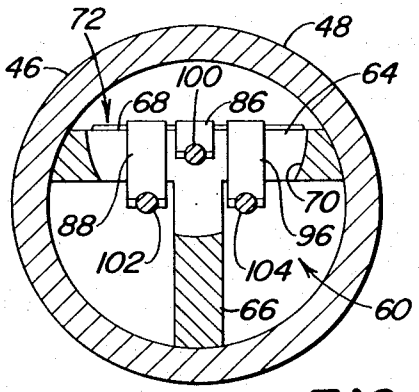
FIG. 4 is a view taken in the direction of arrows 4—4 of FIG. 2.
Figure 3:
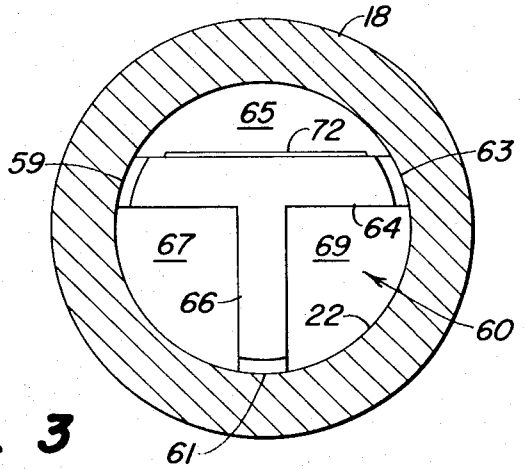
FIG. 3 is a view taken in the direction of arrows 3—3 of FIG. 2.

The support 60 has a substantially T-shaped cross-section (as best seen in FIGS. 3 and 4) formed by a cross piece 64 away from which perpendicularly extends a stiffening ridge 66. The side of cross piece 64, which is opposite the ridge 66, forms a planar support surface 68. A circular edged notch 70 is formed in the end 62 of support 60, as best seen in FIGS. 2 and 4.

The cross piece 64 and the ridge 66 divide the bore 22 into three fluid chambers 65, 67 and 69, of which chambers 65 and 67 are visible in FIG. 2. As best seen in FIGS. 2 and 3, the curved outer peripheral surfaces 59, 61 and 63 of the support 60 slidably engage the wall of the bore 22. This engagement adds rigidity to the support 60 and helps to prevent deformation of the support 60 and reduces vibration to which the support 60 would be subject if it were cantilevered or supported merely at one end.

As best seen in FIGS. 5 and 6*a–d*, a resistance or potentiometer assembly 72 is placed on the planar support surfaces 68 of the cross piece 64. The assembly includes an electrically insulating base 74 fixed to the support surface 68 and which may be formed of material such as "Kapton", a trademark material available from DuPont.

The assembly 72 also includes a conductive plastic potentiometer element 76, of which the largest or elongated central portion thereof is laid directly upon the insulating base 74. The ends 78 and 80 of the potentiometer element are overlaid onto portions of copper or metallic electrical conductive ground and power strips 82 and 84, respectively. The potentiometer element 76 terminates at edges 79 and 81, respectively. Conductive ground strip 82 terminates at edge 83, under the end 78 of the potentiometer element 76, as shown in dashed line in FIG. 5. A conductor 86 is soldered to the other end of ground strip 82. Conductive power strip 84 terminates at an edge 85 under end 80 of the potentiometer element 76, as also shown in dashed line in FIG. 5. The overlaps between the conductive strips 82, 84 and the potentiometer element ends 78, 80 need only be sufficient to provide good electrical continuity therebetween. The other end of power strip 84 is joined via a solder joint to a conductor 88. A metallic or electrical conductive commutator strip 90 is also positioned on the insulating base 74. Commutator strip 90 extends from an edge indicated by reference numeral 92 to an end 94 to which is soldered to a conductor 96. An overlay strip 98 of conductive plastic material is positioned on top of the commutator strip 90 and extends from edge 99 to an edge also indicated by reference numeral 92. The major portion of the power strip 84 is separated from the commutator strip 90 by the middle or potentiometer strip 76 to reduce the possibility of metallic particles forming undesirable short circuit connections between the power strip 84 and the commutator strip 90. Also note that the transducer element 72 is not received in a recess or channel in the support 60, but rather is positioned on top of the planar support surface 68. The absence of a recess or channel reduces the likelihood of metallic particles forming undesirable short circuit connections between the support 60 and the other edges of the power strip 84 and the commutator strip 90. For clarity, the thicknesses of the various strips in FIGS. 6*a–d* are exaggerated.

The conductors 86, 88 and 96 extend from their solder joints, through the notch 70, the terminal member 46 and the ceramic seal 54 to respective connector terminals 100, 102, and 104, two of which are visable in FIG. 2. A conventional female plug-type connector may be coupled to the connector terminals 100, 102 and 104 so that electrical signals may be extracted therefrom.

A wiper carrier 110 is received by bore portion 24 of the bore 22, as best seen in FIG. 2. The wiper carrier 110 has a generally cylindrical body 112 of an insulating material such as glass-reinforced nylon with an annular rabbet 114 in one end thereof. The rabbet 114 registers with the ridge 28 only when the carrier 110 is properly mounted in the bore portion 24, otherwise, the annular ridge 28 will prevent the carrier 110 from being inserted far enough into bore portion 24 to allow insertion of snap ring 126 into snap ring groove 26. A wiper support flange 116 extends inwardly from a portion of the body 112. A two-pronged conductive wiper 118 is embedded in and supported by the flange 116 so that prongs 120 and 122 resiliently and slidably engage the surfaces of plastic conductive strip 98 above commutator strip 90 and the potentiometer element portion 76, respectively. The wiper 118 is exposed to the fluid in chamber 65. As best seen in FIG. 7, the prongs 120 and 122 have multiple fingers. A rectangular recess 124 is formed in the inner surface 125 of the carrier flange 116 so that the inner surface 125 closely registers with the surface 68 of the support element 60 and with the transducer element 72. The carrier 110 is coupled for movement with the rod 18 and piston 16 between snap ring 126 and a resilient wave washer 128.

By taking into account both FIGS. 3 and 7, it can be seen that the portions of wiper carrier 110 which are exposed to fluid in chamber 67 and 69 define a pair of generally sector-shaped spaces between the carrier 110 and either side of ridge 66 of support 60. Thus, as the piston 16 and rod 18 move back and forth with respect to housing 12 and support 60, fluid can freely flow past or through the carrier 110 via chambers 67 and 69, around the end 129 of support 60 and into and out of chamber 65. However, the close sliding fit between the inner surface 125 and surface 68 and element 72 substantially prevents fluid flow through wiper carrier 110 via chamber 65, thus reducing flow-induced turbulence in the vicinity of the wiper 118. This reduced turbulence prevents turbulence-induced vibrations in the wiper 118 which could otherwise introduce noise into the signals picked up by the wiper 118.

MODE OF OPERATION

In operation, a voltage potential is applied across terminals 102 and 100 to apply a corresponding voltage potential across the resistance element 76. As the piston 16 and rod 18 move back and forth within the housing 12, the wiper 118 moves with the piston 16 and rod 18 and with respect to the support 60 and the transducer element 72. Thus, the voltage or potential to which the wiper 118 is subjected varies from ground potential to approximately the voltage at the power strip 84, depending upon the longitudinal position of the wiper 118 relative to the resistance element 76. The voltage on wiper 118 is communicated to the exterior of the cylinder housing 12 via commutator strips 98 and 90, conductor 96 and connector terminal 104, from where it can be monitored to indicate the position of the cylinder 10.

I claim:

1. A position-sensing hydraulic cylinder comprising:
a hollow cylindrical housing;
a piston and rod assembly reciprocal in the housing;

a walled bore extending longitudinally into the piston and rod assembly;

a support fixed with respect to the housing and reciprocally received by the bore, the support including a planar support surface on one side thereof;

a potentiometer assembly including a potentiometer element disposed on the planar support surface, and an electrically conductive wiper means slidably and resiliently engaging the potentiometer element for maintaining electrical continuity therewith; and a wiper carrier coupled for movement with the piston and rod assembly for moving the wiper means relative to the potentiometer assembly, the wiper carrier having means cooperating with the support and the wall of the rod bore for permitting fluid flow past the wiper carrier and for substantially preventing fluid flow past the wiper carrier in the vicinity of the wiper means, the potentiometer assembly generating signals representing relative positions of the wiper means and the potentiometer element.

2. A position-sensing hydraulic cylinder comprising:

a hollow cylindrical housing;

a piston and rod assembly reciprocal in the housing;

a walled bore extending longitudinally into the piston and rod assembly;

a support rigidly fixed with respect to the housing and reciprocally received by the bore, the support including a cross piece having one side defining a planar support surface and a stiffening ridge extending perpendicularly away from another side of the cross piece, the support having a generally T-shaped cross section;

a potentiometer assembly having a potentiometer element disposed on the planar support surface, and wiper means slidably and resiliently engaging the potentiometer element for maintaining electrical continuity therewith; and a wiper carrier fixed for movement with the piston and rod assembly for carrying the wiper means, the wiper carrier including means cooperating with the support for permitting fluid flow through the wiper carrier and for substantially preventing fluid flow in the vicinity of the wiper means.

3. A position-sensing hydraulic cylinder comprising:

a hollow cylindrical housing;

a piston and rod assembly reciprocal in the housing;

a walled bore extending longitudinally into the piston and rod assembly;

a support fixed with respect to the housing and received by the bore, the wall of the bore slidably engaging the support to maintain alignment of the support within the bore, the support comprising a cross piece having one side defining the planar support surface and a stiffening ridge to the cross piece and extending perpendicularly away therefrom, the cross piece and ridge together forming the support with a generally T-shaped cross sectional shape, the cross piece and stiffening ridge having curved peripheral edges slidably engaging the wall of the rod bore;

a potentiometer assembly including an elongated potentiometer element carried on a surface of the support and wiper means slidably and resiliently engaging the potentiometer element for maintaining electrical continuity therewith; and a wiper carrier fixed for movement with the piston and rod assembly for moving the wiper means relative to the potentiometer element, the potentiometer assembly generating signals representing relative positions of the wiper means and the potentiometer element, the wiper carrier having a hollow cylindrical body received by the piston and rod assembly and a wiper flange extending inwardly from the body, an end of the wiper means being embedded in the flange, the hollow body and the support cooperating to define spaces on either side of the stiffening ridge through which fluid flow is freely permitted, the flange having a surface which closely registers with surfaces of the potentiometer element and of the support to substantially prevent fluid flow through the wiper carrier in the vicinity of the wiper means.

4. The invention of claim 3, wherein:

the cross piece and ridge divide the rod bore into first, second and third chambers, the cross piece separating the first chamber from the second and third chambers, the ridge separating the second and third chambers from each other, the second and third chambers being open at both ends thereof to permit fluid flow therethrough upon relative movement between the piston and the housing, the wiper means being exposed to fluid in the first chamber, and the wiper carrier cooperating with the wall of the bore and with the cross piece to close one end of the first chamber thereby substantially preventing fluid flow in the vicinity of the wiper means.

5. The invention of claim 3, wherein:

the wiper carrier comprises a cylindrical body having a rabbet in one end of the outer peripheral surface thereof; and the rod bore being a stepped bore with large and small diameter portions interconnected by an annular shoulder, the large diameter portion receiving the wiper carrier and having a raised annular ridge at one end thereof for registering with the rabbet in the wiper carrier, the annular shoulder providing an abutment for limiting relative movement between the wiper carrier and the rod.

6. The invention of claim 3, further comprising:

a hollow fitting sealingly and removably attached to an end of the housing;

a hollow sleeve sealingly coupled to and received by the hollow fitting and including means rigidly supporting an end of the support; and a sealing plug formed within the hollow sleeve and spaced apart from the support for preventing fluid communication therethrough.

* * * * *

UNITED STATES PATENT AND TRADEMARK OFFICE

CERTIFICATE OF CORRECTION

PATENT NO. : 4,523,514

DATED : 18 June 1985

INVENTOR(S) : Ronnie Franklin Burk

It is certified that error appears in the above-identified patent and that said Letters Patent is hereby corrected as shown below:

In Col. 5, line 57, after "ridge", insert -- fixed --.

Signed and Sealed this

*Eighteenth* Day of *February 1986*

[SEAL]

*Attest:*

DONALD J. QUIGG

*Attesting Officer*

*Commissioner of Patents and Trademarks*